United States Patent [19]

Cribben et al.

[11] 4,229,844

[45] Oct. 28, 1980

[54] SWIMMING POOL COPING

[75] Inventors: James T. Cribben, Mechanicsburg; Richard A. Feeser, Mt. Holly Springs, both of Pa.

[73] Assignee: Ethyl Corporation, Richmond, Va.

[21] Appl. No.: 34,862

[22] Filed: Apr. 30, 1979

[51] Int. Cl.[3] ..... E04H 3/18

[52] U.S. Cl. ..... 52/588; 4/506

[58] Field of Search ..... 4/172, 172.19, 172.21, 4/146; 52/169.7, 169.8, 300, 588, 595, 716

[56] References Cited

U.S. PATENT DOCUMENTS

| | | | |
|---|---|---|---|
| 3,100,556 | 8/1963 | De Ridder | 4/172.19 X |
| 3,298,039 | 1/1967 | Schmerley | 4/172.21 |
| 3,310,814 | 3/1967 | Lipman | 4/172.21 |
| 3,335,429 | 8/1967 | Arp | 4/172.21 |
| 3,347,006 | 10/1967 | Fox | 4/172.21 |
| 3,416,165 | 12/1968 | Pereira | 4/172.21 X |
| 3,500,605 | 3/1970 | Katzman | 4/172.21 |
| 3,512,326 | 5/1970 | Greene | 52/169.7 X |
| 3,579,665 | 5/1971 | Barker | 4/172.19 |
| 3,590,400 | 7/1971 | Kessler | 4/172.21 |
| 3,628,198 | 12/1971 | Katzman | 4/172.21 |
| 3,634,892 | 1/1972 | Rains | 4/172.21 |
| 3,673,751 | 7/1972 | Boassy et al. | 4/172.19 |
| 3,777,318 | 12/1973 | Stillman, Jr. | 4/172.21 |
| 3,835,481 | 9/1974 | Engelhart et al. | 4/172.21 |
| 3,839,748 | 10/1974 | Stillman, Jr. | 4/172.21 |
| 3,840,908 | 10/1974 | Greene | 4/172.19 |
| 3,959,830 | 6/1976 | Vanden Broek | 4/172.21 X |

*Primary Examiner*—Stuart S. Levy

*Attorney, Agent, or Firm*—Donald L. Johnson; John F. Sieberth; James M. Pelton

[57] ABSTRACT

A two-piece coping for a swimming pool comprising an edge piece and a cover piece. The edge piece includes a base plate for fastening to the top of a pool wall, an opening for receiving a pool liner, an opening for pivotally engaging the cover piece, and means on the base plate for engaging fastening means on the cover piece. The cover piece includes means for pivotally engaging the edge piece and means for fastening the cover piece to the fastening means on the base plate of the edge piece.

9 Claims, 5 Drawing Figures

SWIMMING POOL COPING

BACKGROUND OF THE INVENTION

The present invention relates generally to swimming pool copings and particularly to a two-piece swimming pool coping in which the parts are pivotally or hingedly joined together and also snap-fitted together.

Swimming pool copings basically provide a marginal edge for a swimming pool. They usually provide a means by which a swimming pool liner may be easily attached to the edge of a swimming pool. They can also provide a safe, esthetically pleasing finish for the edge of a swimming pool. A wide variety of swimming pool copings have been proposed including one-piece, two-piece and multiple-piece structures. The copings have been made of metal, plastic, wood and/or combinations thereof.

A one-piece type coping which has achieved some degree of success is represented by U.S. Pat. No. 3,298,039. Such coping has a curved or bull-nosed edge, a socket or channel below the curved edge for receiving a pool liner, and a channel for receiving an anchoring bolt. In such construction the anchoring bolts must be fully installed before the coping can be slidably inserted on the bolt-heads. Should an anchor bolt subsequently become loose, the coping must be cmpletely removed to obtain access to the bolt. Another one-piece plastic type coping is illustrated by U.S. Pat. No. 3,335,429. Such coping requires a number of longitudinal ridges for strength and stability. A structure providing a one-piece cover which fits over a one-piece base is set forth in U.S. Pat. Nos. 3,512,326 and 3,579,665.

A multi-part coping is shown in U.S. Pat. No. 3,416,165.

One type of two-piece coping is seen in U.S. Pat. No. 3,310,814. Another type is set forth in U.S. Pat. No. 3,673,751.

Other examples of swimming pool copings are represented by U.S. Pat. Nos. 3,590,400; 3,628,198; 3,634,892; 3,777,318; 3,835,481; 3,839,748; 3,840,908; and 3,959,830.

The present invention provides a two-piece coping which provides the simplicity and smooth appearance of a one-piece coping and which can be quickly and easily assembled.

The present invention especially provides an installation which permits ready access to anchor bolts or other fastening members employed to secure the coping around the pool edge.

Another object of the invention is to provide an aluminum swimming pool coping which allows a top fastener to the pool side in a hidden position.

A further object of the present invention is to provide a two-piece coping of either metal or plastic in which one piece serves as a cover plate and the other piece holds the pool liner and fastener.

Still another object of the invention is to provide a finished or installed swimming pool coping which has a smooth and attractive appearance.

SUMMARY OF THE INVENTION

The present invention comprises a two-piece swimming pool coping. One piece is an edge piece which includes a base plate for anchoring the coping to the pool edge or wall, a curved or bull-nosed part extending from the base plate, a channel below the curved part for receiving the edge of a pool liner, a hooked member for pivotally or hingedly engaging the other piece, and fastening means on the base plate for fastening the other piece to the base plate. The other piece is a cover piece which includes an opening therein for pivotal or hinged engagement with the hooked member of the edge piece and means extending therefrom for fastening the cover piece on the edge piece. When assembled together, the coping presents a relatively even surface for a person to stand upon.

The present invention also provides for a clip which substantially conforms to the outer shape of the assembled two-piece coping and which is mounted over the assembled coping to prevent separation of the two coping parts. A plurality of the clips are fastened on the coping members at appropriate places around the perimeter thereof.

DESCRIPTION OF THE PREFERRED EMBODIMENT

Figure 1:
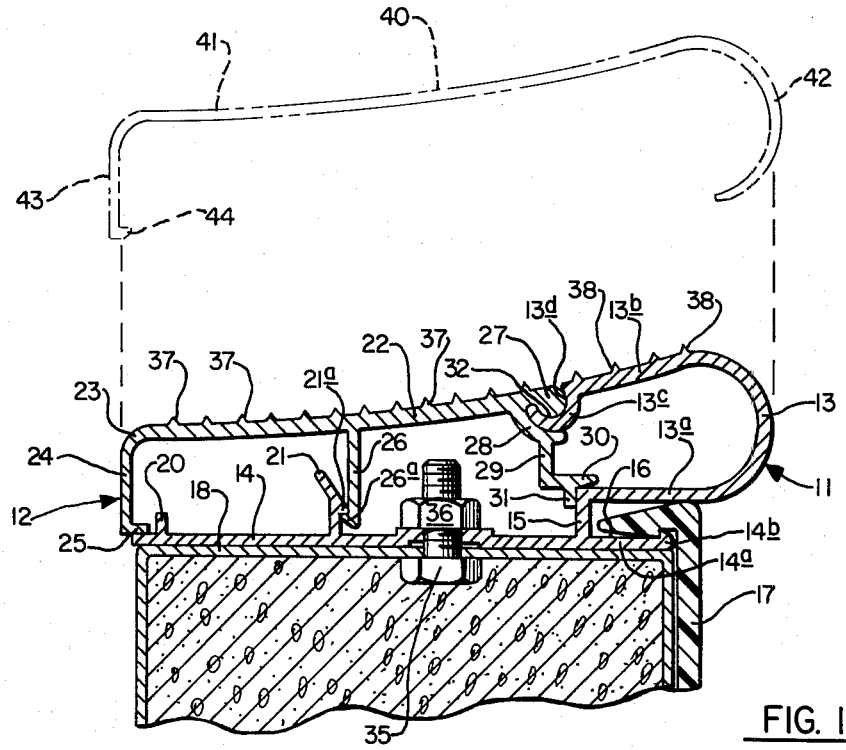
FIG. 1 is a cross-sectional view of the assembled coping of this invention attached to a fragment of the edge or wall of a swimming pool and a vertical side view of a clip of the invention illustrating the manner in which the clip is positioned on the coping.
Figure 2:
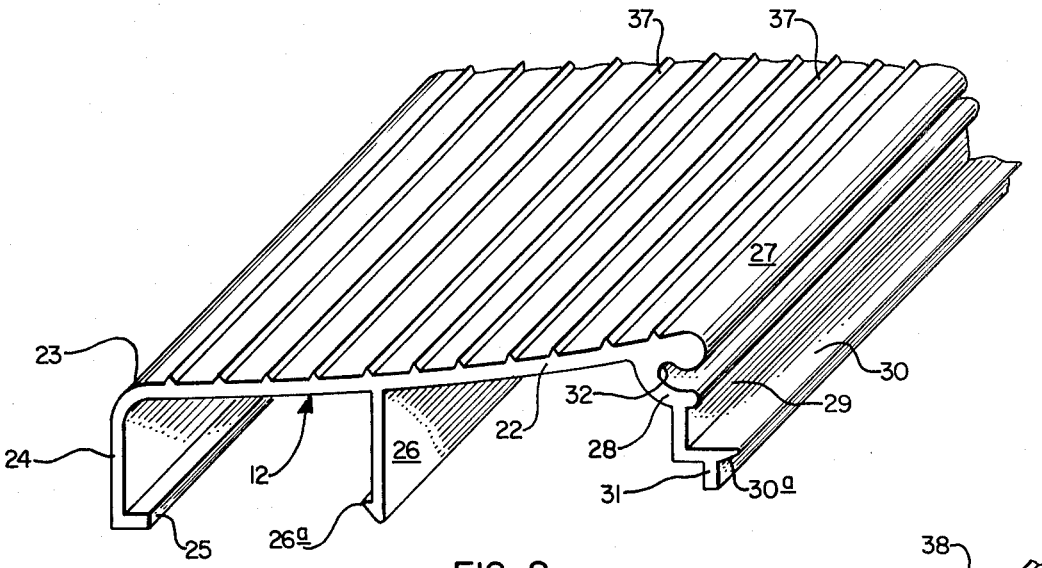
FIG. 2 is a perspective view of the cover piece of FIG. 1.
Figure 3:
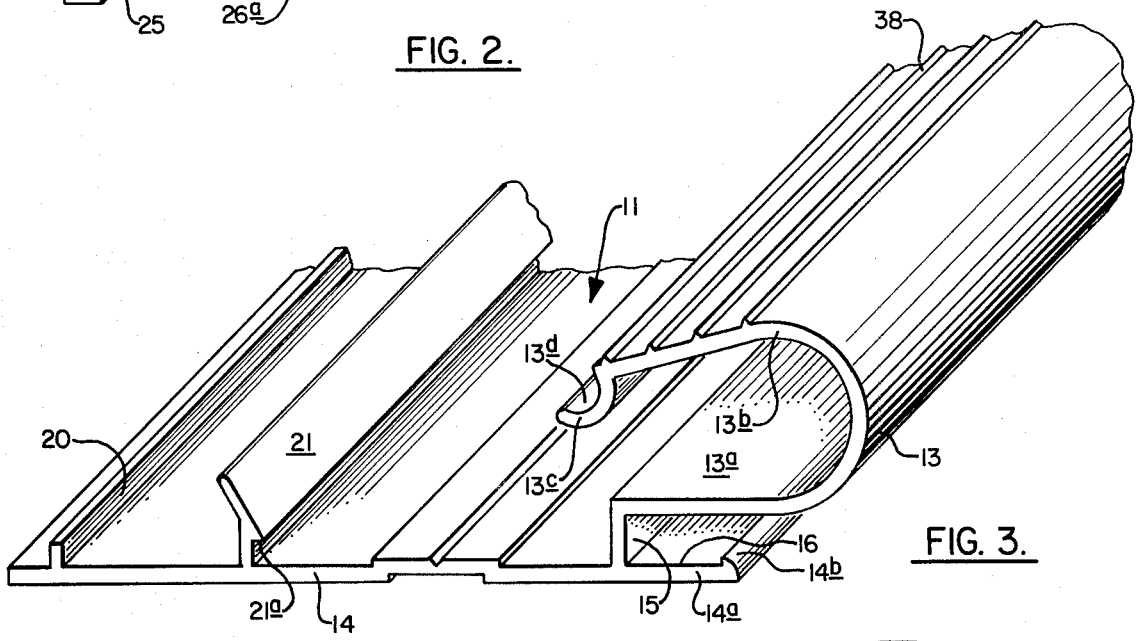
FIG. 3 is a perspective view of the edge piece of FIG. 1.
Figure 4:
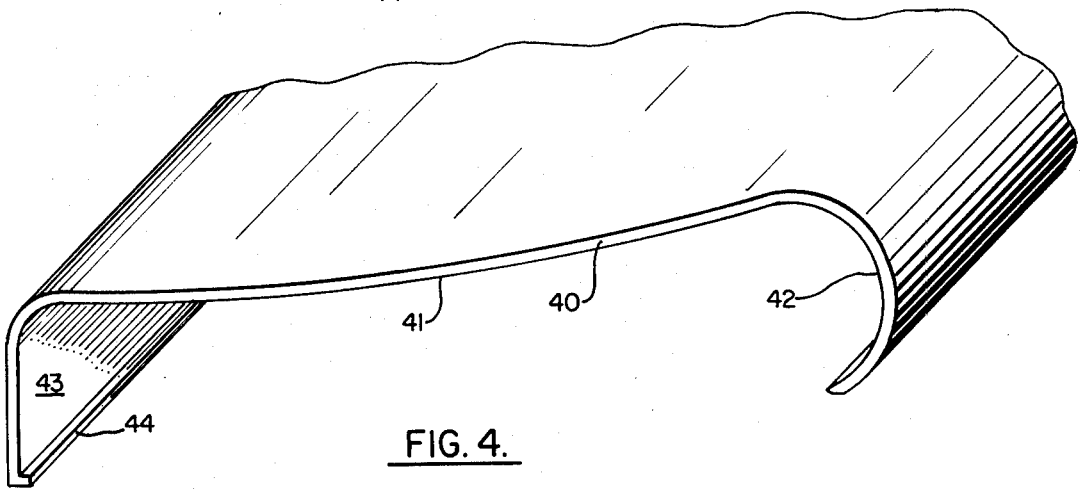
FIG. 4 is a perspective view of the clip of FIG. 1.

Referring now to the drawings in detail, particularly FIGS. 1–3, the present invention is illustrated by a swimming pool coping formed in two parts or pieces. There is an edge piece 11 which is attached to the margin of the pool, and an edge piece or cover piece 12 which is attached to the edge piece. Each piece is preferably an aluminum extrusion or shape, but could also be formed of a suitable plastic. The edge piece is fastened to the pool side and is so constructed as to accept fasteners and the pool liner. The latter is preferably of vinyl or other suitable heavy duty plastic. The cover piece is pivotally engaged and snap-fastened to the edge piece.

The edge piece 11 has a bull-nose or curved part 13 extending from a base plate 14 and joined thereto by a short vertical member 15 which is perpendicular to the base plate. A portion **13*a* of the bull-nose member 13, short member 15 and a portion 14*a* of the base plate 14, form a channel or socket 16 for receiving the beaded edge of a swimming pool liner 17 to hold it in place on the swimming pool wall 18. The member 14*a* has a lip 14*b* extending therefrom to aid in holding the vinyl liner 17 in place. The base plate 14 has a short, lateral member 20 extending perpendicularly therefrom near the other end of the base plate. Also extending from the base plate 14 is a vertical and angular lateral member 21. The member 21 has a lip 21*a* formed thereon. The top portion 13*b* of the bull-nose part 14 extends slightly downwardly and has a curved member 13*c* on the end thereof. The member 13*c* has a curved channel 13*d*** therein.

As seen in FIGS. 1 and 2, the cover piece 12 has a main top part 22 which has a slight downward slope from one end thereof to a curved end 23 which joins vertical member 24. Extending inwardly from the end of the vertical member 24 is short flange 25. Also extending downwardly and vertically perpendicularly from main top part 22, when in its installed position, is vertical member 26. A lip 26*a* is formed on the end of the member 26. One end of the member 22 extends to a rounded or beaded part 27 which has a curved part 28 extending therefrom. A vertical member 29 extends downwardly from the curved member 28 and a flange 30 extends at right angles from the member 29. One edge 30*a* of the member 30 is somewhat angular. A short flange 31 extends downwardly perpendicularly from the member 30. A curved channel 32 is formed by the beaded edge 27 and the curved member 28. The beaded edge 27 is adapted to fit into channel 13*d*. Curved member 13*c* is adapted to fit into channel 32. Such arrangement provides a pivotal or hinged connection between the edge piece 11 and the cover piece 12. When the two pieces are joined together, the member 31 rests against the member 15 and the lip 26*a* interlocks with the lip 21*a*. Flange 25 rests on base plate 14.

The base plate 14 is conveniently anchored to the wall 18 of the swimming pool by bolt 35 extending through the wall 18 and through an opening in the base 14 and with nut 36 tightened on the bolt 25.

A non-slip surface is provided by a plurality of longitudinally extending ridges or striations 37 on the top of the member 22 and similar ridges or striations 38 on top of the member 13*b*.

The piece 11 and the piece 12, when joined together and locked in place, form the swimming pool coping of the instant invention. When two copings, i.e., an assembled edge piece and cover piece, are joined together in an end-to-end relationship, a coping cover piece 40 is preferably snapped thereover. Such coping piece has a curved edge 41 which follows the general contour of the top of cover piece 12 and top piece 13*b* of edge piece 11. The member 40 also has a bull-nose shaped end 42 which is generally of the configuration of bull-nose part 13. Extending on the other end of the member 40 is leg 43 which extends downwardly and vertically of a configuration approximating that of the parts 23, 24 and 25 of the member 12. Extending from the leg 43 is lip 44. The member 40, when placed on the coping, effectively covers the space or joining area of two swimming pool copings.

Figure 1A:
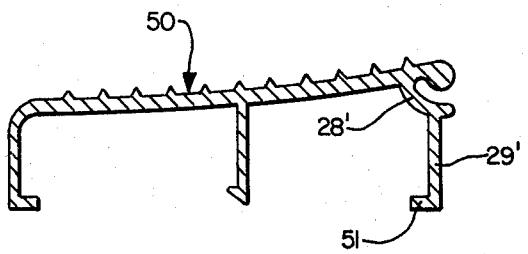
FIG. 1A is a cross-sectional view of an alternate embodiment of the cover piece of this invention.

Referring now to FIG. 1A, an alternate cover piece 50 is illustrated. The cover piece 50 is substantially the same as cover piece 12 except that the member 29' extends vertically downwardly from curved part 28' and ends in flange 51 which rests on the base plate 14. The additional construction of the member 50 is similar to that of the member 12. It can be appreciated that a variety of configurations and/or joining arrangements can be utilized without departing from the spirit of the invention.

The edge piece and the cover piece which form the swimming pool coping are preferably aluminum shapes. They may, however, be of plastic or other suitable material. The joining cover member 40 is also preferably aluminum, but may also be steel, plastic or any other suitable material. Such material is preferably somewhat flexible so that it may be readily snapped over the swimming pool coping. Although the cover or clip is preferred, it may of course be omitted.

While the invention has been disclosed herein by reference of the details of the preferred embodiment, it is to be understood that such disclosure is intended in an illustrative, rather than a limiting sense, and it is contemplated that various modifications of the construction and arrangement of the parts will readily occur to those skilled in the art, within the spirit of the invention and the scope of the appended claims.

What is claimed is:

1. A swimming pool coping comprising an edge piece and a cover piece; said edge piece including a base plate for attachment to a wall of a swimming pool, an intermediate member extending upwardly from the base plate for engaging a corresponding central member of the cover piece, a channel extending from one end of the base plate for receiving the edge of a swimming pool liner, a curved outer end extending from the upper wall of the channel and mating means extending from the upper part of the curved outer end for pivotally engaging mating means on the cover piece; said cover piece including a mating means on said cover piece for pivotally engaging the edge piece mating means, a member extending downwardly from the cover piece mating means for resting on the edge piece, a vertical member extending downwardly from the other end of the cover piece for resting on one edge of the base plate and a central member extending downwardly from the cover piece between the mating means and the vertical member for engaging the intermediate member on the base plate of the edge piece; wherein the mating means on the edge piece includes a downwardly extending curved member which forms a curved channel for receiving a beaded edge on one end of the cover piece and the mating means on the cover piece comprises a beaded edge for engaging the curved channel of the mating means of the edge piece and a curved member extending downwardly and outwardly from the mating means of the cover piece below the beaded edge which forms a channel with the beaded edge for receiving the downwardly extending curved member of the mating means on the edge piece.

2. The device according to claim 1, wherein the edge piece includes a short member extending upwardly and perpendicularly from the edge of the base plate opposite the liner receiving channel.

3. The device according to claim 1, wherein the downwardly extending vertical member has a flange extending inwardly and horizontally from the end thereof for resting on the base plate of the edge piece.

4. The device according to claim 1, wherein the intermediate member of the edge piece and the central member of the cover piece each have lips thereon which are adapted to be engaged with each other.

5. The device according to claim 1, wherein when the edge piece and cover piece are joined together, a relatively even surface is formed on the surface of the coping for contact with a part of a person.

6. The device according to claim 1, wherein a plurality of longitudinal ridges are formed on the upper surface of each the edge piece and the cover piece.

7. The device according to claim 1, wherein the member extending downwardly from the cover piece mating means has a flange extending outwardly and horizontally therefrom and the flange has a short vertical member extending perpendicularly downwardly therefrom at an intermediate position thereon.

8. The device according to claim 1, wherein the member extending downwardly from the cover piece mating means extends sufficiently downwardly to rest on the base plate of the edge piece and the downwardly extending member has an inwardly extending flange thereon for resting on the base plate of the edge piece.

9. The device according to claim 1, wherein the base plate of the edge piece has a plurality of means therein for receiving bolts for attaching the base plate to a wall of a swimming pool.

* * * * *

UNITED STATES PATENT AND TRADEMARK OFFICE

CERTIFICATE OF CORRECTION

PATENT NO. : 4,229,844

DATED : October 28, 1980

INVENTOR(S) : James T. Cribben and Richard A. Feeser

It is certified that error appears in the above–identified patent and that said Letters Patent are hereby corrected as shown below:

Cover page in item [73], "Ethyl Corporation, Richmond, Va." should read -- Capitol Products Corporation, Mechanicsburg, Pa. --. Column 3, line 6, reads "member 22" should read -- main top part 22 --.

Signed and Sealed this

*Seventeenth* Day of *March 1981*

[SEAL]

*Attest:*

RENE D. TEGTMEYER

*Attesting Officer*

*Acting Commissioner of Patents and Trademarks*